US008447622B2

(12) United States Patent
Xu et al.

(10) Patent No.: US 8,447,622 B2
(45) Date of Patent: May 21, 2013

(54) DECODING METHOD AND DEVICE

(75) Inventors: Jianfeng Xu, Shenzhen (CN); Lijing Xu, Shenzhen (CN); Qing Zhang, Shenzhen (CN); Wei Li, Shenzhen (CN); Shenghu Sang, Shenzhen (CN); Zhengzhong Du, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 752 days.

(21) Appl. No.: 12/427,848

(22) Filed: Apr. 22, 2009

(65) Prior Publication Data

US 2009/0204394 A1 Aug. 13, 2009

Related U.S. Application Data

(63) Continuation of application No. PCT/CN2007/071171, filed on Dec. 4, 2007.

(30) Foreign Application Priority Data

Dec. 4, 2006 (CN) ..... 2006 1 0162678

(51) Int. Cl.
*G10L 19/00* (2006.01)
*G10L 19/14* (2006.01)

(52) U.S. Cl.
USPC ..... 704/501; 704/205; 704/228

(58) Field of Classification Search
None
See application file for complete search history.

(56) References Cited

U.S. PATENT DOCUMENTS

| | | | |
|---|---|---|---|
| 5,673,363 | A | 9/1997 | Jeon et al. |
| 5,862,518 | A | 1/1999 | Nomura et al. |
| 6,144,936 | A | 11/2000 | Järvinen et al. |
| 6,233,708 | B1 | 5/2001 | Hindelang et al. |

(Continued)

FOREIGN PATENT DOCUMENTS

| | | | |
|---|---|---|---|
| CN | 1134581 | A | 10/1996 |
| CN | 1168751 | A | 12/1997 |

(Continued)

OTHER PUBLICATIONS

Written Opinion of the International Searching Authority in corresponding PCT Application No. PCT/CN2007/071171 (Mar. 13, 2008).

(Continued)

*Primary Examiner* — Brian Albertalli
(74) *Attorney, Agent, or Firm* — Leydig, Voit & Mayer, Ltd.

(57) ABSTRACT

A decoding method and device are provided. The spectrum parameter of a current bad data frame is determined. Specifically, a number of continuous bad frames that occur currently is determined. A spectrum parameter of a good data frame before the current bad data frame is determined. And a constant mean value of a spectrum parameter is determined. Then, the spectrum parameter of the good data frame is adaptively shifted towards the constant mean value of the spectrum parameter according to the number of the continuous bad data frames to calculate and obtain spectrum parameter information of the current bad frame. When the continuous bad data frames occur, the relevance between the spectrum parameter of the nearest good frame and the spectrum parameter of the current bad frame is gradually reduced, so that more accurate spectrum parameter of the current bad data frame can be obtained, thereby obtaining a better speech quality under a same code rate and a same frame error rate.

16 Claims, 4 Drawing Sheets

U.S. PATENT DOCUMENTS

| | | | | |
|---|---|---|---|---|
| 6,408,267 | B1 | 6/2002 | Proust | |
| 6,636,829 | B1 * | 10/2003 | Benyassine et al. | 704/201 |
| 6,810,377 | B1 | 10/2004 | Ho et al. | |
| 6,968,309 | B1 * | 11/2005 | Makinen et al. | 704/219 |
| 7,031,926 | B2 * | 4/2006 | Makinen et al. | 704/500 |
| 7,529,673 | B2 * | 5/2009 | Makinen et al. | 704/265 |
| 7,590,525 | B2 * | 9/2009 | Chen | 704/211 |
| 7,991,612 | B2 * | 8/2011 | Chen et al. | 704/219 |
| 2002/0091523 | A1 | 7/2002 | Makinen et al. | |
| 2006/0150049 | A1 * | 7/2006 | Zhang et al. | 714/746 |
| 2006/0184861 | A1 * | 8/2006 | Sun et al. | 714/776 |

FOREIGN PATENT DOCUMENTS

| | | | |
|---|---|---|---|
| CN | 1489762 | A | 4/2004 |
| CN | 1535461 | A | 10/2004 |
| CN | 100578618 | C | 1/2010 |
| WO | 02/35520 | A2 | 5/2002 |

OTHER PUBLICATIONS

International Search Report in corresponding PCT Application No. PCT/CN2007/071171 (Mar. 13, 2008).

1st Office Action in corresponding Chinese Application No. 200610162678.5 (Oct. 10, 2008).

Supplemental European Search Report in corresponding European Application No. 07817361 (Aug. 25, 2009).

"G.729—Coding of Speech at 8 kbit/s Using Conjugate-Structure Algebraic-Code-Excited-Linear-Prediction (CS-ACELP)," General Aspects of Digital Transmission Systems, ITU-T Recommendation G.729, Mar. 1996, International Telecommunication Union, Geneva, Switzerland.

"3GPP2 C.S0014-0—Enhanced Variable Rate Codec (EVRC)," 3rd Generation Partnership Project 2 "3GPP2," Version 1.0, 3rd Generation Partnership Project, Valbonne, France, Dec. 1999.

"3GPP TS 26.090—3rd Generation Partnership Project; Technical Specification Group Services and System Aspects; Mandatory Speech Codec speech processing functions; Adaptive Multi-Rate (AMR) speech codec; Transcoding functions (Release 6)," Dec. 2004, Version 6.0.0, 3rd Generation Partnership Project, Valbonne, France.

"3GPP TS 26.091—3rd Generation Partnership Project; Technical Specification Group Services and System Aspects; Mandatory Speech Codec speech processing functions; Adaptive Multi-Rate (AMR) speech codec; Error concealment of lost frames (Release 6)," Dec. 2004, Version 6.0.0, 3rd Generation Partnership Project, Valbonne, France.

"3GPP TS 26.190—3rd Generation Partnership Project; Technical Specification Group Services and System Aspects; Speech codec speech processing functions; Adaptive Multi-Rate—Wideband (AMR-WB) speech codec; Transcoding functions (Release 6)," Jul. 2005, Version 6.1.1, 3rd Generation Partnership Project, Valbonne, France.

"3GPP TS 26.191—3rd Generation Partnership Project; Technical Specification Group Services and System Aspects; Speech codec speech processing functions; Adaptive Multi-Rate—Wideband (AMR-WB) speech codec; Error concealment of erroneous or lost frames (Release 6)," Dec. 2004, Version 6.0.0, 3rd Generation Partnership Project, Valbonne, France.

"3GPP TS 26.290—3rd Generation Partnership Project; Technical Specification Group Service and System Aspects; Audio codec processing functions; Extended Adaptive Multi-Rate—Wideband (AMR-WB+) codec; Transcoding functions (Release 6)," Jun. 2005, Version 6.3.0, 3rd Generation Partnership Project, Valbonne, France.

* cited by examiner

DECODING METHOD AND DEVICE

CROSS-REFERENCE TO RELATED APPLICATIONS

This application is a continuation of International Patent Application No. PCT/CN2007/071171, filed Dec. 4, 2007, which claims priority to Chinese Patent Application No. 200610162678.5, filed Dec. 4, 2006, both of which are hereby incorporated by reference in their entirety.

FIELD OF THE INVENTION

The present invention relates to a speech decoding technology field, and more particularly to a technology for processing a bad frame received by a speech decoder.

BACKGROUND

In a communication system, code streams generated by a speech encoder based on algebraic code excited linear prediction (ACELP) take one speech frame as a unit. A transmission process for input data in each frame is shown in FIG. 1, a speech encoder at a sending end encodes the input data into a group of parameters. The parameters are generally quantized and then transmitted via a communication channel. Accordingly, a decoder at a receiving end needs to re-synthesizes the received parameters into a speech signal, thereby realizing the transmission of the speech signal.

Generally, the speech frame generated by the ACELP-based speech encoder involves the following parameters: a spectrum parameter, an adaptive code parameter, an algebraic code parameter, an adaptive code gain and an algebraic code gain, etc. The spectrum parameter includes a linear predictive coefficient (LPC) parameter, which is adapted to indicate a spectrum shape of a short-time speech.

In the speech encoder, the LPC parameter is generally quantized first and then transmitted. In order to reduce the quantization error, the speech encoder may convert the LPC parameter into a spectrum parameter such as a linear spectral frequency (LSF) or an immittance spectral frequency (ISF), and then the spectrum parameter is quantized.

At the receiving end, after receiving the speech frame sent from the sending end, if it is determined that the speech frame is wrong or is lost (or referred to as a bad frame), the spectrum parameter in the bad frame needs to be replaced. In this way, by synthesizing the speech signal using the replaced spectrum parameter, a problem that the decoded speech is deteriorated due to the bad frame is thus overcome effectively.

Several commonly used solutions for replacing the spectrum parameter in the prior art are described below.

Solution 1

The spectrum parameter adopted by an enhanced variable rate codec (EVRC) encoder is the LSF. When a frame error occurs, the EVRC speech decoder takes the LSF of the previous frame as an LSF of an error frame: $\Omega_q(m)=\Omega_q(m-1)$ where $\Omega_q(m)$ indicates an LSF vector of the current frame, and $\Omega_q(m-1)$ indicates an LSF vector of the previous frame.

Apparently, in this solution of realizing the replacement of the spectrum parameter by concealing the frame error of the EVRC speech coder, the variation of the spectrum parameter as the time elapsed is not considered at all, which inevitably results in a failure in synthesizing a comfortable speech at the decoding end when bad frames occur continuously.

Solution 2

Each frame of an adaptive multi-rate (AMR) encoder includes four sub-frames, and the AMR encoder adopts a 10-order LSF as the spectrum parameter. When a frame error occurs, the AMR speech decoder shifts the LSF of the previous frame towards a constant mean value of the LSF, and then takes the obtained value as an LSF of the error frame, that is:

$$lsf_q1(i)=lsf_q2(i)=\alpha\ \text{past}_lsf_q(i)+(1-\alpha)\ \text{mean}_lsf(i),\ i=0\ldots 9$$

where $\alpha=0.95$, lsf_q1, lsf_q2 indicate LSF vectors of the second and fourth sub-frames of the current frame, mean_lsf (i) indicates a constant mean value vector obtained by calculating a mean value of the spectrum parameters obtained by detecting the speech signals for a long term (that is, a constant mean value of the spectrum parameters), and past_lsf_q indicates an LSF vector of the second sub-frame of the previous frame.

The LSF vectors of the first and third sub-frames in the current frame are obtained by performing an interpolation to the LSF vectors of the second and fourth sub-frames.

In this solution for realizing the replacement of the spectrum parameter by concealing the frame error of the AMR speech coder, when the bad frames occur continuously, the relevance between the LSF of the nearest previous frame and that of the current bad frame is weakened, so that the corresponding calculation behavior for the replacement of the spectrum parameter fails to obtain an ideal spectrum parameter.

Solution 3

An adaptive multi-rate wideband (AMR-WB) encoder and an extended adaptive multi-Rate wideband (AMR-WB+) encoder adopt a 16-order ISF as the spectrum parameter. Once a frame error occurs, the AMR-WB and AMR-WB+ speech decoders shift the ISF of the previous frame towards a partial adaptive mean value of the ISFs to act as the ISF of the error frame, that is:

$$ISF_q(i)=\alpha*\text{past}_ISF_q(i)+(1-\alpha)*ISF_{mean}(i),\ i=0\ldots 15$$

in the above equation, $\alpha=0.9$; $ISF_q(i)$ indicates an ISF vector of the current frame; $\text{past}_ISF_q(i)$ indicates an ISF vector of the previous frame; $ISF_{mean}(i)$ indicates a partial adaptive mean value of the ISFs formed by the adaptive mean value of the ISFs and the constant mean value of the ISFs: $ISF_{mean}(i)=\beta*ISF_{const_mean}(i)+(1-\beta)ISF_{adaptive_mean}(i)$, $i=0\ldots 15$; where $\beta 8=0.25$;

$$ISF_{adaptive_mean}(i)=\frac{1}{3}\sum_{i=0}^{2}\text{past}_ISF_q(i)$$

indicates an adaptive mean value of the spectrum parameters of the nearest three good frames, and the parameter is updated each time when a good frame is determined; and $ISF_{const_mean}(i)$ indicates a constant mean value vector of the ISF vector (that is, the constant mean value of the spectrum parameters).

In this solution for realizing the replacement of the spectrum parameter by concealing the frame error of the AMR-WB and AMR-WB+ speech coders, when a plurality of bad frames occurs continuously, the relevance between the ISFs of the nearest good frame and that of the current bad frame is weakened, so that the corresponding operating manner for the replacement of the spectrum parameters still fails to obtain preferred spectrum parameters; that is, it fails to obtain desirable speech performance.

SUMMARY

Embodiments of the present invention provide a decoding method and device to determine accurate spectrum parameters for error frames during a decoding process, thereby enhancing a quality of a synthesized speech.

The present invention provides a decoding method, which includes: receiving data frames, detecting bad data frames, determining a spectrum parameter of a current bad date frame, and performing a decoding operation according to the determined spectrum parameter of the current bad data frame to obtain decoded data. Determining the spectrum parameter of the current bad data frame includes: determining a number of continuous bad data frames that occur, a spectrum parameter of a good frame before the current bad frame and a constant mean value of the spectrum parameter; and adaptively shifting the spectrum parameter of the good frame towards the constant mean value of the spectrum parameter according to the number of the continuous bad frames to determine the spectrum parameter of the current bad frame.

The present invention further provides a decoding device, which includes a spectrum parameter calculation unit for determining a spectrum parameter of a current bad frame. The spectrum parameter calculation unit provides the determined spectrum parameter to a decoding entity, so as to perform a decoding operation. The spectrum parameter calculation unit specifically includes: (1) a parameter obtaining unit for determining the number of continuous bad frames that currently occur, a spectrum parameter of a good frame before the current bad frame, and a constant mean value of the spectrum parameter; and (2) a spectrum parameter determination unit for adaptively shifting the spectrum parameter of the nearest good frame towards the constant mean value of the spectrum parameter according to the number of the continuous bad frames determined by the parameter obtaining unit to calculate and obtain spectrum parameter information of the current bad frame.

As seen from the technical solution provided according to embodiments of the present invention, when the continuous bad frames occur in the embodiments of present invention, the relevance between the spectrum parameters of the nearest good frame and that of the current bad frame is gradually reduced, so that more accurate spectrum parameter information of the current bad frame may be obtained. Therefore, a better speech quality may be obtained under a same bit rate and a same frame error rate.

Furthermore, when a frame error occurs and the spectrum parameter needs to be replaced in the embodiments of present invention, merely the spectrum parameter of a good frame nearest to the current bad frame is taken as the spectrum parameter of the nearest good frame, without using the spectrum parameters of an even earlier good frame again. Thus, the embodiments of the present invention may save a memory of the decoder and reduce calculation complexity effectively.

DETAILED DESCRIPTION

The present invention relates to a specific implementation solution about a decoding method and device. In the implementation solution, a decoding end receives data frames sent from an encoding end; and, if any bad frame occurs among the received data frames, the decoding end needs to calculate and determine a spectrum parameter of the current bad frame; and then, a decoding operation is performed according to the calculated and determined spectrum parameter of the bad frame to obtain a decoded data. During the decoding process, the accurate decoding process cannot be performed on the received data frames until the spectrum parameter of the bad frame that occurs is determined accurately.

The present invention provides a decoding method and device, which can accurately calculate and determine the spectrum parameter of the bad frame during the decoding process, thereby enhancing the performance of the decoding process.

The specific implementation solution for accurately determining the spectrum parameter of the bad frame according to the present invention is described below in detail.

During the data transmission, it can be known through analysis that, the relevance between the spectrum parameter of a nearest good frame and that of the current bad frame is greater than the relevance between the spectrum parameters of the other good frames and that of the current bad frame. Thus, when it performs calculations once again for the replacement of the spectrum parameter, spectrum parameter information of the other good frames may not be taken in to account.

Specifically, in the embodiments of the present invention, the number of continuous bad frames that occur recently is calculated statistically, in which when continuous bad frames occur, the relevance between the nearest good frame and the current bad frame is gradually reduced during the replacement of the spectrum parameter. Furthermore, when a frame error occurs and the spectrum parameter needs to be replaced, merely the spectrum parameter of the nearest good frame is adopted so as to save the memory of the decoder and reduce the calculation complexity. In other words, in the embodiments of the present invention, specifically, the spectrum parameter of the good frame is adaptively shifted towards the constant mean value of the spectrum parameter according to the number of the continuous bad frames to calculate and obtain the spectrum parameter information of the current bad frame.

In order to make the embodiments of present invention more comprehensible, the specific implementation process of the method of the embodiments of present invention is described below in detail with reference to the accompanying drawings.

Figure 1:
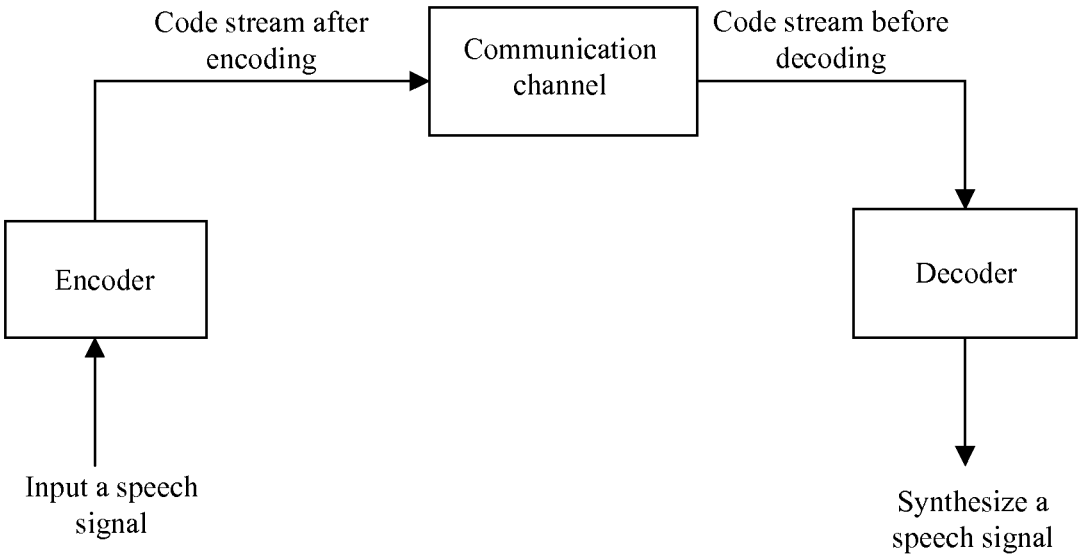
FIG. 1 is a schematic view of a transmission process of a speech signal.
Figure 2:
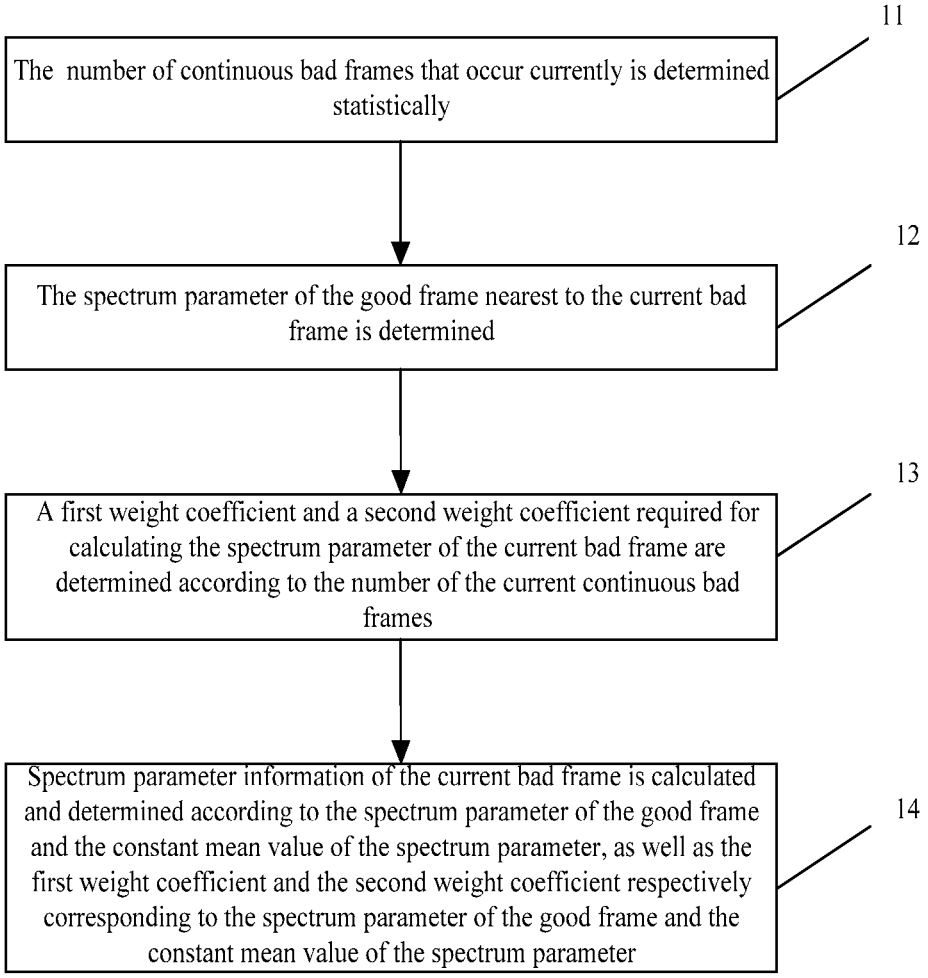
FIG. 2 is a schematic view of a process of a method according to an embodiment of the present invention.

The process for determining the spectrum parameter of the current bad frame in the method according to an embodiment of the present invention is shown in FIG. 2. In order to realize the process shown in FIG. 2, the number of continuous bad frames that occur currently, the spectrum parameter of the good frame before the bad frame and the constant mean value of the spectrum parameter are recorded and saved beforehand at the decoding end, and then the corresponding process specifically includes the following steps.

Step 11: At the decoding end, the number of continuous bad frames that occur currently is determined.

Step 12: The spectrum parameter of the good frame nearest to the current bad frame is determined.

The good frame is one good frame before the current bad frame. Particularly, the good frame may be one good frame nearest to the current bad frame, or may be a plurality of good frames nearest to the current bad frame, and one good frame is selected preferably. If a plurality of good frames is adopted, it further needs to calculate and determine the spectrum parameters corresponding to the plurality of good frames.

Step 13: A first weight coefficient and a second weight coefficient required for calculating the spectrum parameter of the current bad frame are determined according to the number of the current continuous bad frames. Since a sum of the first weight coefficient and the second weight coefficient is 1, at fist merely one of the weight coefficients needs to be calculated and obtained.

Specifically, the first weight coefficient of the spectrum parameter of the good frame and the second weight coefficient of the constant mean value of the spectrum parameter are determined according to the number of the continuous bad frames that occur currently, which specifically includes the following two manners.

(1) In a first manner for calculating the weight coefficients, a preset first adaptive function that takes the number of the continuous bad frames as a variable is adopted to calculate the second weight coefficient. The first adaptive function is any function whose value increases as the number of the continuous bad frames increases, and the first weight coefficient is calculated and determined according to the second weight coefficient.

(2) In a second manner for calculating the weight coefficients, a second adaptive function that takes the number of the continuous bad frames as a variable is adopted to calculate the first weight coefficient. The second adaptive function is any function whose value decreases as the number of the continuous bad frames increases, and the second weight coefficient is determined according to the first weight coefficient.

Step 14: Spectrum parameter information of the current bad frame is calculated and determined according to the spectrum parameter of the good frame and the constant mean value of the spectrum parameter, as well as the first weight coefficient and the second weight coefficient respectively corresponding to the spectrum parameter of the good frame and the constant mean value of the spectrum parameter.

In this step, specifically, a sum of the product of the first weight coefficient and the spectrum parameter of the good frame and the product of the second weight coefficient and the constant mean value of the spectrum parameter is taken as the spectrum parameter of the current bad frame.

In which the constant mean value of the spectrum parameter is a constant mean value vector obtained after calculating a constant mean value of the spectrum parameter obtained by detecting speech signals for a long time.

The application process of the present invention is described below through a specific application embodiment.

Specifically, an ISF is, for example, selected as the spectrum parameter, and it is supposed that the number of the continuous bad frames that occur currently, the spectrum parameter of the good frame before the bad frames and the constant mean value of the spectrum parameter are all known. In an embodiment of the present invention, when a frame error occurs (that is, a bad frame occurs), an ISF of a previous good frame nearest to the current bad frame is adaptively shifted towards the constant mean value of the ISF according to the number of the nearest continuous bad frames, and the obtained value serves as an ISF of the error frame, and a specific process specifically includes the follows:

It is assumed that, in this embodiment, the preset first adaptive function is: 1−f(bfi_count), where f(bfi_count) is an adaptive function that takes a parameter bfi_count indicating the number of the continuous bad frames as a variable, and it increases as a value of bfi_count increases, and 0≦f(bfi_count)≦1. Or, the preset second adaptive function is: f(bfi_count). The two adaptive functions may be set beforehand, or one of the adaptive functions is set, and the other one is calculated and obtained according to the set adaptive function.

Based upon the above assumptions, in this embodiment, the spectrum parameter ISF of the current bad frame is:

$$ISF_q(i)=[1-f(bfi_count)]*past_ISF_q(i)+f(bfi_count)*ISF_{const_mean}(i) \quad (1)$$

i=0, 1, . . . , order−1;

where, $ISF_q(i)$ is an ISF vector of the current frame;

$past_ISF_q(i)$ is an ISF vector of the previous good frame;

$ISF_{const_mean}(i)$ is a long-term constant mean value vector of the ISF vector, in other words, the constant mean value of the spectrum parameter, which may be referred to as the constant mean value of the ISF;

bfi_count is the number of the nearest continuous bad frames; and order is an order number of the spectrum parameter.

As known from the above equation (1), when the number of the nearest continuous bad frames, the ISF value of the previous good frame and the constant mean value of the ISF are known, the spectrum parameter ISF of the current bad frame may be calculated and obtained. Furthermore, the overall calculation process is rather simple. Meanwhile, since the parameter of the number of the continuous bad frames is considered during the process of calculating the spectrum parameter, the calculated and obtained spectrum parameter is more accurate, thereby obtaining a better speech quality at the decoding end.

It should be noted that, in an embodiment of the present invention, if the LSF is taken as the spectrum parameter, the above calculation manner may still be adopted to calculate the spectrum parameter, and the corresponding calculation process is the same as that described above, and thus is not repeated herein.

Based upon the above embodiment, the present invention is described below in detail with reference to a more specific application embodiment. In this embodiment, it is assumed that the adaptive function is:

$$f(\text{bfi_count}) = \frac{\text{bfi_count}}{\text{bfi_count}+1},$$

in other words, 1−f(bfi_count) will be $$\frac{1}{\text{bfi_count}+1},$$

thus a corresponding calculation formula for the spectrum parameter ISF is:

$$ISF_q(i) = \frac{1}{\text{bfi_count}+1} * \text{past_ISF}_q(i) + \frac{\text{bfi_count}}{\text{bfi_count}+1} * ISF_{const_mean}(i) \quad (2)$$

$i = 0, 1, \ldots, \text{order} - 1;$ in which, meanings of the parameters in the equation (2) are the same as that of the parameters in the equation (1); and the value of the spectrum parameter ISF of the current bad frame may be calculated accurately by the equation (2).

Figure 3:
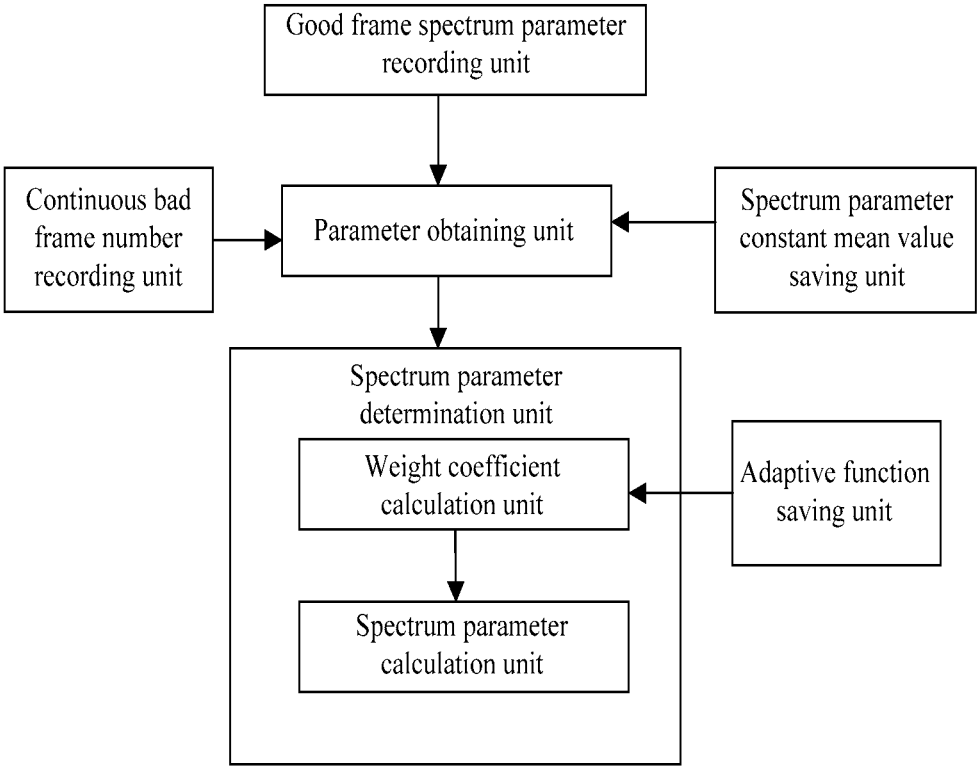
FIG. 3 is a schematic view of a structure of a device according to an embodiment of the present invention.

An embodiment of the present invention further provides a decoding device, which is adapted in a speech decoder, and includes a spectrum parameter calculation unit adapted to perform an error concealment process on bad frames, in other words, adapted to calculate a spectrum parameter of a current bad frame. The spectrum parameter calculation unit is further adapted to provide the determined spectrum parameter to a decoding entity, so that the decoding entity performs a decoding operation according to the determined spectrum parameter. The structure of the device according to an embodiment of the present invention is shown in FIG. 3, in which the spectrum parameter calculation unit specifically includes a parameter obtaining unit and a spectrum parameter determination unit.

(1) Parameter obtaining unit: The parameter obtaining unit is particularly adapted to obtain the number of continuous bad frames that occur currently, a spectrum parameter of a good frame before a bad frame and a constant mean value of the spectrum parameter. The spectrum parameter of the good frame before the bad frame is a spectrum parameter of the good frame nearest to the current bad frame.

Therefore, a decoding end needs to set a continuous bad frame number recording unit, a good frame spectrum parameter recording unit and a spectrum parameter constant mean value saving unit, which are respectively adapted to record and save the number of bad frames received continuously recently, the spectrum parameter of the previous good frame and the constant mean value of the saved spectrum parameter that are calculated statistically, so as to provide various corresponding parameter information for the parameter obtaining unit.

(2) Spectrum parameter determination unit: The spectrum parameter determination unit is adapted to calculate a displacement value for the spectrum parameter of the current bad frame according to the number of bad frames received continuously recently, the spectrum parameter of the previous good frame and the constant mean value of the spectrum parameter. Specifically, the spectrum parameter determination unit is adapted to adaptively shift the spectrum parameter of the good frame towards the constant mean value of the spectrum parameter according to the number of the continuous bad frames determined by the parameter obtaining unit, thereby calculating and obtaining the spectrum parameter information of the current bad frame.

The spectrum parameter determination unit specifically includes a weight coefficient calculation unit and a spectrum parameter calculation unit, in which: the weight coefficient calculation unit is adapted to determine a first weight coefficient of the spectrum parameter of the good frame and a second weight coefficient of the constant mean value of the spectrum parameter according to the number of the continuous bad frames that occur currently, in which the sum of the first weight coefficient and the second weight coefficient is 1; and the spectrum parameter calculation unit is adapted to calculate and determine the spectrum parameter information of the current bad frame according to the spectrum parameter of the good frame and the constant mean value of the spectrum parameter, as well as the first weight coefficient and the second weight coefficient respectively corresponding to the spectrum parameter of the good frame and the constant mean value of the spectrum parameter.

(3) Adaptive function saving unit: Preferably, the device further includes an adaptive function saving unit, which is adapted to save the first adaptive function that takes the number of the continuous bad frames as a variable. The value of the first adaptive function increases as the number of the continuous bad frames increases. Or, the adaptive function saving unit is adapted to save the second adaptive function that takes the number of the continuous bad frames as a variable. The value of the second adaptive function decreases as the number of the continuous bad frames increases. In other words, in this unit, both of the two adaptive functions may be preset and saved, or merely one of the adaptive functions is set and saved, and accordingly, the other adaptive function is obtained through calculation according to the set and saved adaptive function.

After the first adaptive function is output to the weight coefficient calculation unit, the weight coefficient calculation unit calculates and determines the second weight coefficient according to the first adaptive function and the known number of the continuous bad frames, and then the first weight coefficient is calculated and obtained according to the second weight coefficient. Or, the weight coefficient calculation unit calculates and determines the first weight coefficient according to the second adaptive function and the known number of the continuous bad frames, and then the second weight coefficient is calculated and obtained according to the first weight coefficient.

The first adaptive function saved in the adaptive function saving unit is $$\frac{1}{\text{bfi_count}+1},$$

where bfi_count is the number of the continuous bad frames. Or, the second adaptive function is:

$$\frac{\text{bfi_count}}{\text{bfi_count}+1}.$$

Figure 4:
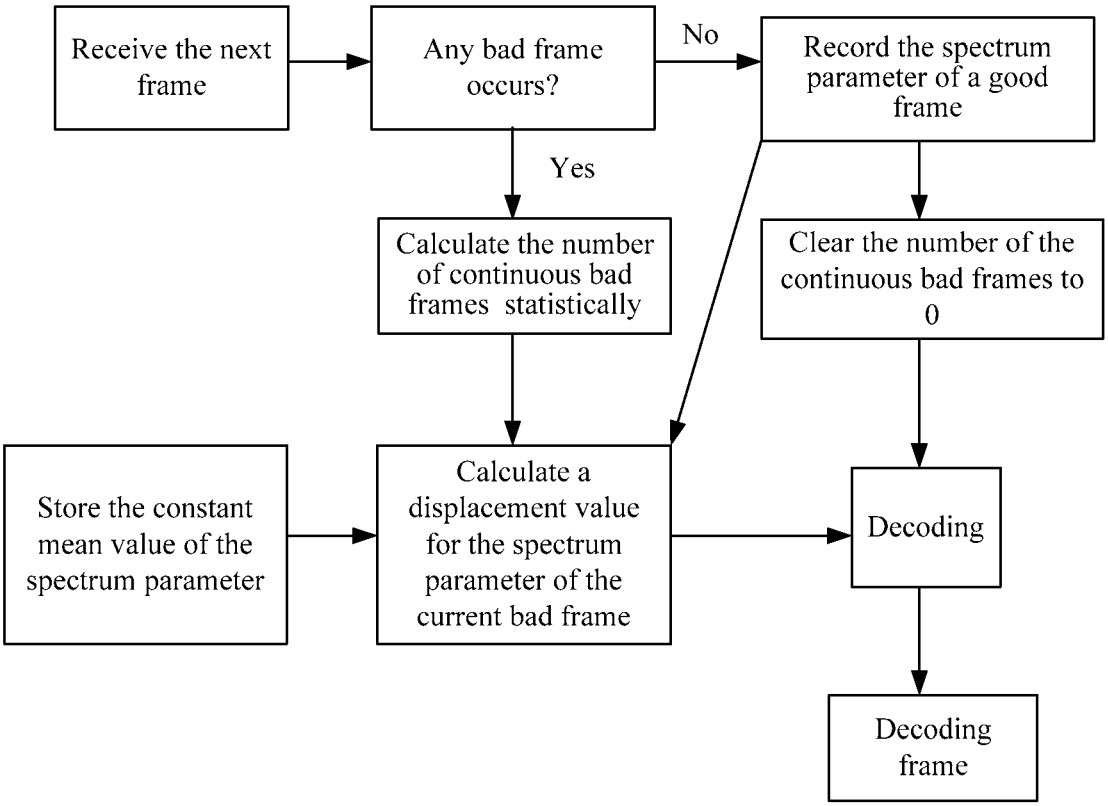
FIG. 4 is a schematic view of a process according to an embodiment of the present invention.

The implementation solution provided by an embodiment of the present invention is described below through an embodiment of a complete decoding process, which is specifically shown in FIG. 4 and includes.

When receives a data frame, the decoding end determines whether the data frame is a bad frame (in other words, determines whether an error occurs to the data frame), and if the current frame is a bad frame, the number of continuous bad frames is calculated statistically, and then a replacement value of a spectrum parameter of the current bad frame is calculated and determined according to the statistical number of the continuous bad frames, a saved constant mean value of the spectrum parameter and the recorded spectrum parameter of a good frame nearest to the current bad frame. The specific calculation manner has already been described above, and thus is not described in detail herein. If the current frame is a good frame, the spectrum parameter of the good frame is recorded, which is provided for calculating a replacement value of the spectrum parameter subsequently. Meanwhile, since the current frame is a good frame, the number of the continuous bad frames is cleared to 0, in other words, the number of the continuous bad frames needs to be calculated statistically once again.

The corresponding decoding process includes: for the current good frame, the spectrum parameter of the good frame is directly utilized to perform the subsequent decoding process; for a situation that the current frame is a bad frame, the calculated and obtained displacement value of the spectrum parameter for the current frame is utilized to perform the subsequent decoding process.

In summary, in the embodiments of the present invention, when the continuous bad frames occur, the relevance between the spectrum parameter of the nearest good frame and that of the current bad frame is gradually reduced at the decoding end, so that a better speech quality is obtained under the same code rate and the same frame error rate. Furthermore, after the frame error occurs in the embodiments of the present invention, the spectrum parameter of only one nearest good frame is taken as a reference for calculating the spectrum parameter of the current bad frame, without using the spectrum parameters of even early good frames. Thus, the embodiments of the present invention may save the memory of the decoder and reduce the calculation complexity effectively.

Though illustration and description of the present disclosure have been given with reference to preferred embodiments thereof, it should be appreciated by persons of ordinary skill in the art that various changes in forms and details can be made without deviation from the spirit and scope of this disclosure, which are defined by the appended claims.

What is claimed is:

1. A decoding method, comprising:

receiving data frames;

detecting bad data frames;

determining a spectrum parameter of a current bad data frame; and performing a decoding operation according to the determined spectrum parameter of the current bad data frame to obtain decoded data;

wherein determining the spectrum parameter of the current bad data frame comprises:

determining a number of continuous bad data frames that occur, a spectrum parameter of a good data frame before the current bad data frame and a constant mean value of the spectrum parameter; and adaptively shifting the spectrum parameter of the good data frame towards the constant mean value of the spectrum parameter according to the number of continuous bad data frames to determine the spectrum parameter of the current bad frame.

2. The method according to claim 1, wherein the good data frame before the current bad data frame is a good data frame nearest to the current bad data frame.

3. The method according to claim 1, wherein determining the spectrum parameter of the current bad data frame further comprises:

determining a first weight coefficient of the spectrum parameter of the good data frame and a second weight coefficient of the constant mean value of the spectrum parameter according to the number of the continuous bad data frames that occur, wherein a sum of the first weight coefficient and the second weight coefficient is 1; and calculating and determining the spectrum parameter of the current bad data frame according to the spectrum parameter of the good data frame and the constant mean value of the spectrum parameter, as well as the first weight coefficient and the second weight coefficient respectively corresponding to the spectrum parameter of the good data frame and the constant mean value of the spectrum parameter.

4. The method according to claim 3, wherein:

the second weight coefficient is calculated and obtained according to a first adaptive function that takes the number of the continuous bad data frames as a variable, and the first adaptive function increases as the number of the continuous bad data frames increases.

5. The method according to claim 3, wherein:

the first weight coefficient is calculated and obtained according to a second adaptive function that takes the number of the continuous bad data frames as a variable, and the second adaptive function decreases as the number of the continuous bad data frames increases.

6. The method according to claim 4, wherein the first adaptive function is:

$$\frac{1}{\text{bfi_count}+1},$$

where bfi_count is the number of the continuous bad data frames.

7. The method according to claim 5, wherein the second adaptive function is:

$$\frac{\text{bfi_count}}{\text{bfi_count}+1},$$

where bfi_count is the number of the continuous bad data frames.

8. The method according to claim 1, further comprising:

recording and saving beforehand the number of the continuous bad data frames that occur, the spectrum parameter of the good data frame before the current bad data frame and the constant mean value of the spectrum parameter.

9. A decoding device, comprising:

a spectrum parameter calculation unit for determining a spectrum parameter of a current bad data frame;

a decoding entity responsive to the determined spectrum parameter for performing a decoding operation;

the spectrum parameter calculation unit specifically comprises:

a parameter obtaining unit for determining the number of continuous bad data frames that occur, a spectrum parameter of a good data frame before the current bad data frame and a constant mean value of the spectrum parameter; and a spectrum parameter determination unit for adaptively shifting the spectrum parameter of the good data frame towards the constant mean value of the spectrum parameter according to the number of the continuous bad data frames determined by the parameter obtaining unit to calculate and obtain spectrum parameter information of the current bad data frame.

10. The device according to claim 9, wherein the spectrum parameter of the good data frame before the current bad data frame obtained by the parameter obtaining unit is a spectrum parameter of a good data frame nearest to the current bad data frame.

11. The device according to claim 9, wherein the spectrum parameter determination unit specifically comprises:

a weight coefficient calculation unit for determining a first weight coefficient of the spectrum parameter of the good data frame and a second weight coefficient of the constant mean value of the spectrum parameter according to the number of the continuous bad data frames that occur, wherein a sum of the first weight coefficient and the second weight coefficient is 1; and a spectrum parameter calculation unit for determining the spectrum parameter information of the current bad data frame according to the spectrum parameter of the good data frame and the constant mean value of the spectrum parameter, as well as the first weight coefficient and the second weight coefficient respectively corresponding to the spectrum parameter of the good data frame and the constant mean value of the spectrum parameter.

12. The device according to claim 9, wherein the device further comprises:

an adaptive function saving unit for saving a first adaptive function that takes the number of the continuous bad data frames as a variable, wherein the first adaptive function increases as the number of the continuous bad data frames increases; and after the first adaptive function is output to the weight coefficient calculation unit, the weight coefficient calculation unit determines the second weight coefficient by using the first adaptive function and the known number of the continuous bad data frames.

13. The device according to claim 9, wherein the device further comprises:

an adaptive function saving unit for saving a second adaptive function that takes the number of the continuous bad data frames as a variable, wherein the second adaptive function decreases as the number of the continuous bad data frames increases; and the weight coefficient calculation unit determines the first weight coefficient by using the second adaptive function and the known number of the continuous bad data frames.

14. The device according to claim 12, wherein the first adaptive function saved in the adaptive function saving unit is:

$$\frac{1}{\text{bfi_count}+1},$$

where bfi_count is the number of the continuous bad data frames.

15. The device according to claim 13, wherein the second adaptive function is:

$$\frac{\text{bfi_count}}{\text{bfi_count}+1},$$

where bfi_count is the number of the continuous bad data frames.

16. The device according to claim 9, further comprising: a continuous bad data frame number recording unit, a good data frame spectrum parameter recording unit and a spectrum parameter constant mean value saving unit, respectively adapted to record and save the number of the continuous bad data frames that occur, the spectrum parameter of the good data frame before the current bad data frame and the constant mean value of the spectrum parameter, and further adapted to provide the number of the continuous bad data frames that occur, the spectrum parameter of the good data frame before the current bad data frame and the constant mean value of the spectrum parameter for the parameter obtaining unit.

* * * * *